US007621057B1

(12) United States Patent
Julian et al.

(10) Patent No.: US 7,621,057 B1
(45) Date of Patent: Nov. 24, 2009

(54) CUSHIONING SYSTEM FOR A SHOE

(76) Inventors: Michael K. Julian, 25 Citrus Dr., Palm Harbor, FL (US) 34684; Mark C. Julian, 8605 Woodcrest Dr., Port Richey, FL (US) 34668; Catherine L. Julian, 8605 Woodcrest Dr., Port Richey, FL (US) 34668; Kirby L. Julian, 8605 Woodcrest Dr., Port Richey, FL (US) 34668

( * ) Notice: Subject to any disclaimer, the term of this patent is extended or adjusted under 35 U.S.C. 154(b) by 0 days.

(21) Appl. No.: 12/004,460

(22) Filed: Dec. 20, 2007

Related U.S. Application Data

(60) Provisional application No. 60/876,901, filed on Dec. 22, 2006.

(51) Int. Cl.
*A43B 13/28* (2006.01)
*A43B 13/38* (2006.01)

(52) U.S. Cl. ..... 36/27; 36/44; 36/28

(58) Field of Classification Search ..... 36/27, 36/44, 28, 43, 30 R, 151, 158, 168, 7.8
See application file for complete search history.

(56) References Cited

U.S. PATENT DOCUMENTS

| | | | | | |
|---|---|---|---|---|---|
| 1,108,369 | A | * | 8/1914 | Horvath | 36/38 |
| 1,172,811 | A | * | 2/1916 | Lewis | 36/151 |
| 1,510,841 | A | * | 10/1924 | Hanley | 36/38 |
| 2,124,496 | A | * | 7/1938 | Peil | 36/151 |
| 2,422,923 | A | * | 6/1947 | Peil | 36/151 |
| 2,669,038 | A | * | 2/1954 | De Werth | 36/38 |
| 4,815,221 | A | * | 3/1989 | Diaz | 36/27 |
| 4,879,821 | A | * | 11/1989 | Graham et al. | 36/44 |

* cited by examiner

*Primary Examiner*—Ted Kavanaugh
(74) *Attorney, Agent, or Firm*—Ted Masters

(57) ABSTRACT

A cushioning system for a shoe includes an insert having a top surface, an opposite bottom surface, the bottom surface having a heel portion, an arch portion, and a ball portion. At least one spring is connected to the heel portion of the bottom surface, and an arch support is connected to the arch portion of the bottom surface. In an embodiment of the invention, an arch support module covers the heel and arch portions of the bottom surface, and carries a plurality of heel springs and the arch support.

2 Claims, 5 Drawing Sheets

CUSHIONING SYSTEM FOR A SHOE

CROSS REFERENCE TO RELATED APPLICATION

This application claims the filing benefit under 35 U.S.C. §119(e) of U.S. Provisional Application No. 60/876,901, filed Dec. 22, 2006, which is herein incorporated by reference.

TECHNICAL FIELD

The present invention pertains generally to shoes, and more particularly to a cushioning system for a shoe which cushions the foot by absorbing some of the shock of walking or running.

BACKGROUND OF THE INVENTION

When a person walks or runs, the shock of his or her feet contacting the ground or other support surface is passed from ground through the person's shoe to the person's feet, legs, hips, back and other body parts. This shock can cause foot, knee, leg, hip, and back strain/pain, and also fatigue.

BRIEF SUMMARY OF THE INVENTION

The present invention is directed to a cushioning system for a shoe which substantially reduces the shock of walking and running, and which can be used with any shoe. The cushioning system is removably placed in the shoe and absorbs shock, is comfortable, is light weight, is durable, is breathable, and keeps the feet dry. Because of the cushioning effect, the present invention prevents knee and back strain/pain, reduces foot fatigue, and allows a person to walk or run with less effort.

The present invention comprises a foot-shaped insert fabricated from a breathable heat absorbing material such as foam rubber, and having a fabric top side. When installed in a shoe, the foot-shaped insert absorbs shock on the foot. Foot-shaped inserts of this type are known in the shoe art. In the present invention, at least one spring is connected to the heel portion of the bottom of the insert, and an arch cushion is connected to the arch portion of the bottom of the insert. In an embodiment of the invention, five springs are arranged in an x-pattern to evenly distribute the weight of the user's heel.

In a preferred embodiment of the invention, a cushioning system for a shoe includes an insert having a top surface, an opposite bottom surface, the bottom surface having a heel portion, an arch portion, and a ball portion. At least one spring is connected to the heel portion of the bottom surface, and an arch support is connected to the arch portion of the bottom surface.

In accordance with an aspect of the invention, the at least one spring includes five springs arranged in an x-shaped pattern.

In accordance with another aspect of the invention, the arch support has a wedge shape.

In accordance with another aspect of the invention, a spring support member is connected to the heel portion of the bottom surface, and the spring support member carries the at least one spring.

In accordance with another aspect of the invention, the spring support member is bonded to the bottom surface.

In accordance with another aspect of the invention, the at least one spring is molded into the spring support member.

In accordance with another aspect of the invention, the arch support is an integral part of the spring support member.

In accordance with another aspect of the invention, a ball cushion is connected to the ball portion of the bottom surface.

In accordance with another aspect of the invention, an arch support module is connected to the bottom surface, the arch support module substantially covering the heel and the arch portions of the bottom surface. The at least one spring and the arch support are disposed on the arch support module.

In accordance with another aspect of the invention, the arch support module includes at least one protuberance, the protuberance having a first cavity for receiving the at least one spring. The arch support module includes a heel cushion disposed between the insert and the protuberance, the heel cushion having a second cavity for receiving the at least one spring. The at least one spring is received by both the first cavity of the protuberance and the second cavity of the heel cushion.

In accordance with another aspect of the invention, arch support module includes a plurality of ventilation holes.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
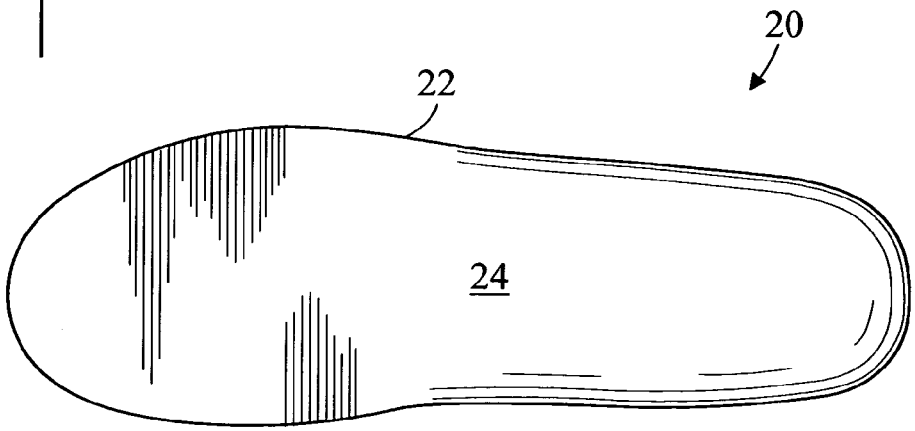
FIG. 1 is a top plan view of a cushioning system for a shoe in accordance with the present invention.
Figure 2:
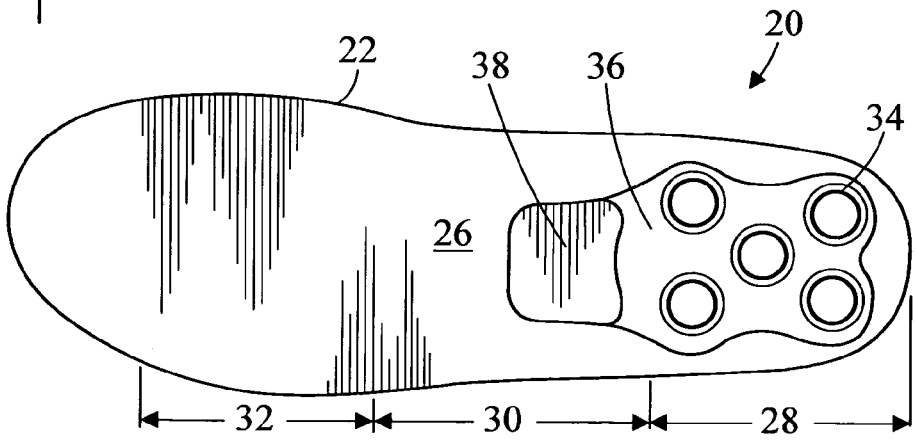
FIG. 2 is a bottom plan view of the cushioning system.
Figure 3:
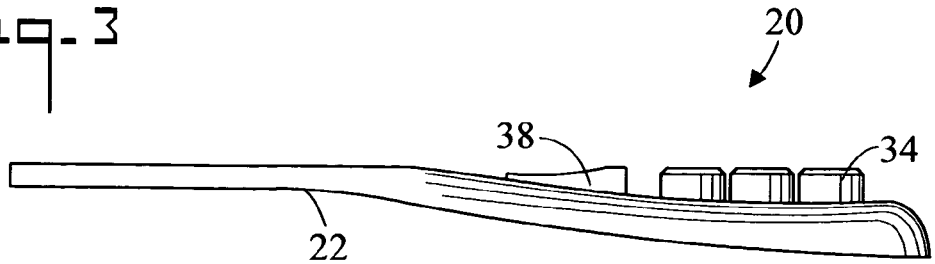
FIG. 3 is a side elevation view of the cushioning system.

Referring initially to FIGS. 1-4, there are illustrated top plan, bottom plan, side elevation, and bottom perspective views respectively of a cushioning system for a shoe in accordance with the present invention, generally designated as 20. Cushioning system 20 includes a commercially available foot-shaped insert 22 fabricated from a breathable heat absorbing material such as foam rubber. It may be appreciated that foot-shaped insert 22 could alternatively be fabricated from plastic or another suitable material. Insert 22 has a top surface 24 which can be made from fabric, and an opposite bottom surface 26. Bottom surface 24 has a heel portion 28, an arch portion 30, and a ball portion 32. At least one spring 34 is connected to heel portion 28 of bottom surface 26. In the shown embodiment, five springs 34 are connected to heel portion 28, and are arranged in an x-shaped pattern (i.e. four outer springs 34 and one central spring 34). The x-shaped spring pattern provides distributed and balanced cushioning for the heel of the user.

In an embodiment of the invention, a spring support member 36 is connected to heel portion 28 of bottom surface 24, and carries the at least one spring 34. Spring support member 36 is bonded (such as with an adhesive) to bottom surface 26. In an embodiment of the invention, spring support member 36 is fabricated from foam rubber wherein the at least one spring 34 is molded into spring support member 36 (refer to FIG. 5 and the associated discussion).

In an embodiment of the invention, springs 34 are helical compression coil springs and have the following characteristics:

Walking version—10 pounds of force are required to fully compress each spring 34. Therefore in the shown five spring embodiment 50 pounds of force will fully compress all five springs 34.

Sports version—26 pounds of force are required to fully compress each spring 34. Therefore in the shown five spring embodiment 130 pounds off force will fully compress all five springs 34.

An arch support 38 for supporting the arch of the user's foot is connected to arch portion 30 of bottom surface 26. In the shown embodiment, arch support 38 has a wedge shape, is an integral part of spring support member 36, and is fabricated from foam rubber. When a user steps on cushioning system 20, springs 34 and arch support 38 compress thereby providing a cushioning "bounce back effect" effect.

Figure 4:
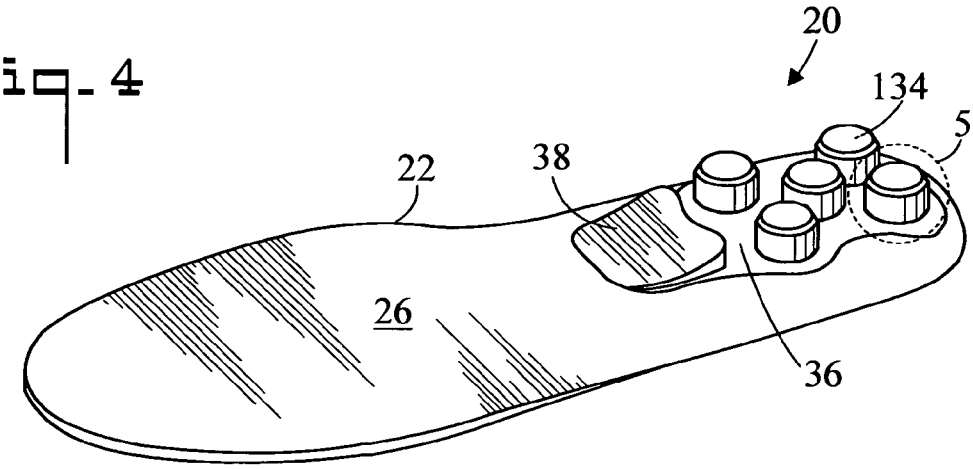
FIG. 4 is a bottom perspective view of the cushioning system.
Figure 5:
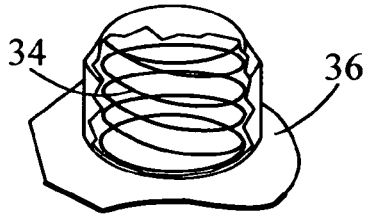
FIG. 5 is an enlarged cutaway view of area 5 of FIG. 4.

FIG. 5 is an enlarged cutaway view of area 5 of FIG. 4, showing spring 34 molded into the rubber of spring support member 36.

Figure 6:
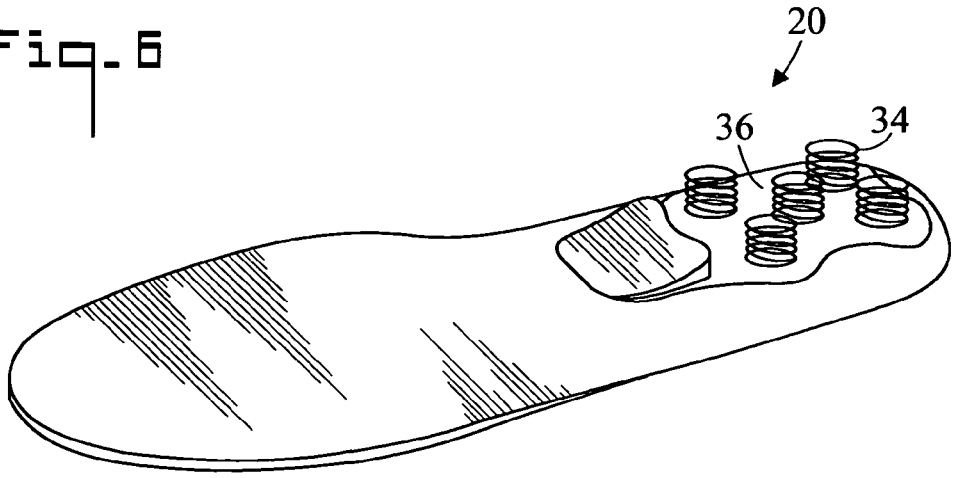
FIG. 6 is a bottom perspective view of an alternate spring configuration.

FIG. 6 is a bottom perspective view of an alternate spring configuration. In this configuration, springs 34 are connected to spring support member 36, rather than being molded into spring support member 36.

Figure 7:
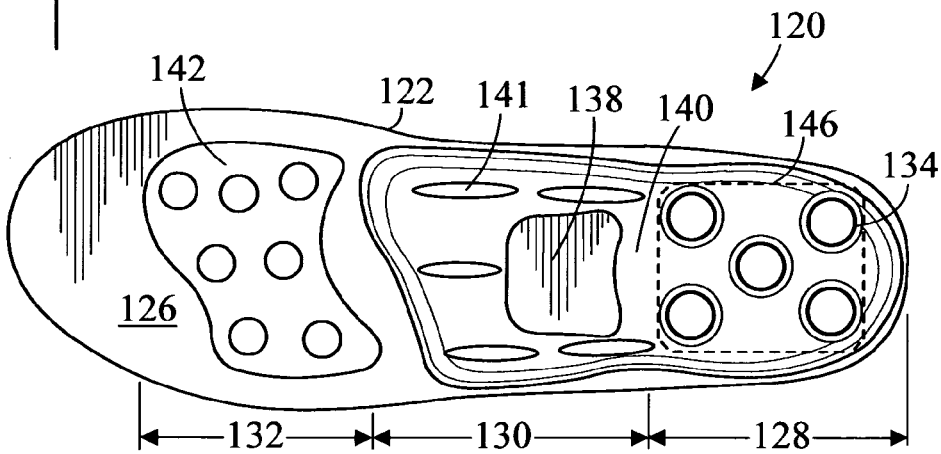
FIG. 7 is a bottom plan view of a second embodiment of the cushioning system.
Figure 8:
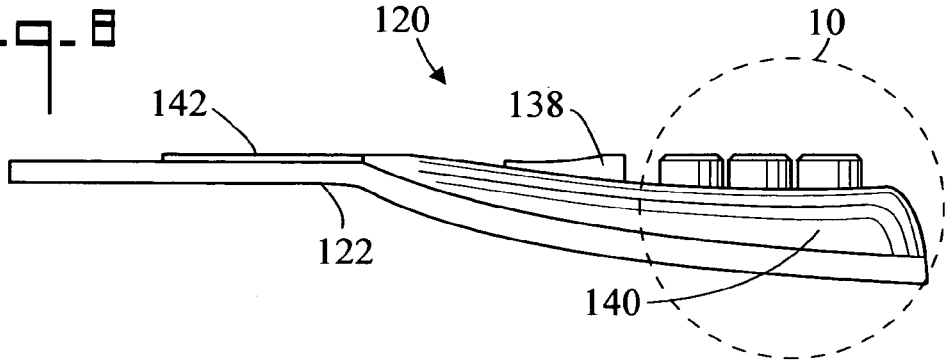
FIG. 8 is a side elevation view of the second embodiment.
Figure 9:
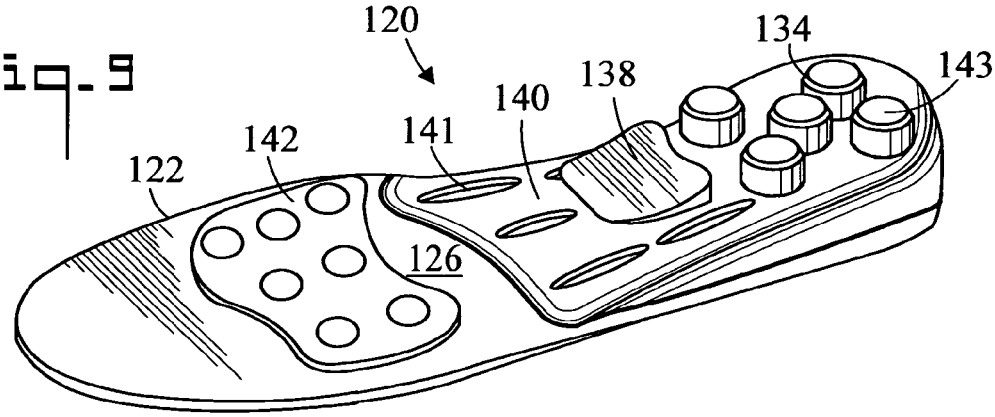
FIG. 9 is bottom perspective view of the second embodiment.

Now referring to FIGS. 7-9, there are illustrated bottom plan, side elevation, and bottom perspective views respectively of a second embodiment of the cushioning system of the present invention, generally designated as 120. Cushioning system 120 is similar to cushioning system 20 and includes a foot-shaped insert 122 having a bottom surface 126 having a heel portion 128, an arch portion 130, and a ball portion 132. At least one spring 134 (also refer to FIGS. 10 and 11) and a wedge-shaped arch support 138 are connected to bottom surface 126. As with cushioning system 20, five springs 134 are arranged in an x-shaped pattern. Cushioning system 120 also includes an arch support module 140 which is connected to bottom surface 126 of insert 122, and which substantially covers heel portion 128 and arch portion 130. Because of the irregular shape of arch support module 140, in FIG. 9 it has been outlined with a bold line to show its boundary. Arch support module 140 is fabricated from a light weight polymer having sufficient rigidity to provide support to the arch of the user's foot. Arch support module 140 carries at least one spring 134 and arch support 138. Arch support module 140 includes a plurality of ventilation holes 141 which promote air circulation.

In another embodiment of the invention, a ball cushion 142 is connected to ball portion 132 of bottom surface 126. Ball cushion 142 is fabricated from rubberized foam. It may be appreciated that ball cushion 142 could also be included in cushioning system 20 as shown in FIGS. 1-4.

Figure 10:
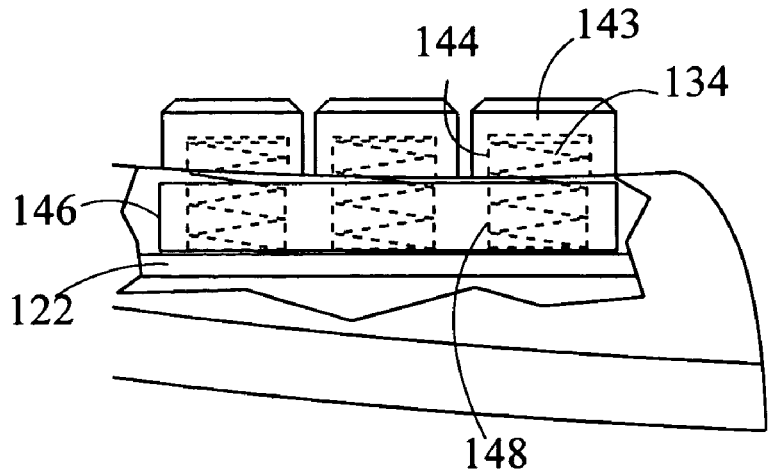
FIG. 10 is an enlarged cutaway view of area 10 of FIG. 8.

FIG. 10 is an enlarged cutaway view of area 10 of FIG. 8. Arch support module 140 includes at least one protuberance 143, protuberance 143 having a first cavity 144 for receiving the at least one spring 134. Arch support module 140 also includes a heel cushion 146 which is disposed between insert 122 and protuberance 143, heel cushion 146 has a second cavity 148 for receiving at least one spring 134. In an embodiment of the invention, heel cushion 146 is a substantially rectangular pad fabricated from foam rubber (refer also to FIG. 11). At least one spring 134 is received by both first cavity 144 of protuberance 143 and second cavity 148 of heel cushion 146. It may be appreciated that in the shown five spring 134 embodiment, heel cushion 146 covers most of heel portion 128, and has five second cavities 148 which are shaped and dimensioned to accept the five springs 134 (also refer to heel cushion 146 shown in dashed lines in FIG. 7, and to FIG. 11).

Figure 11:
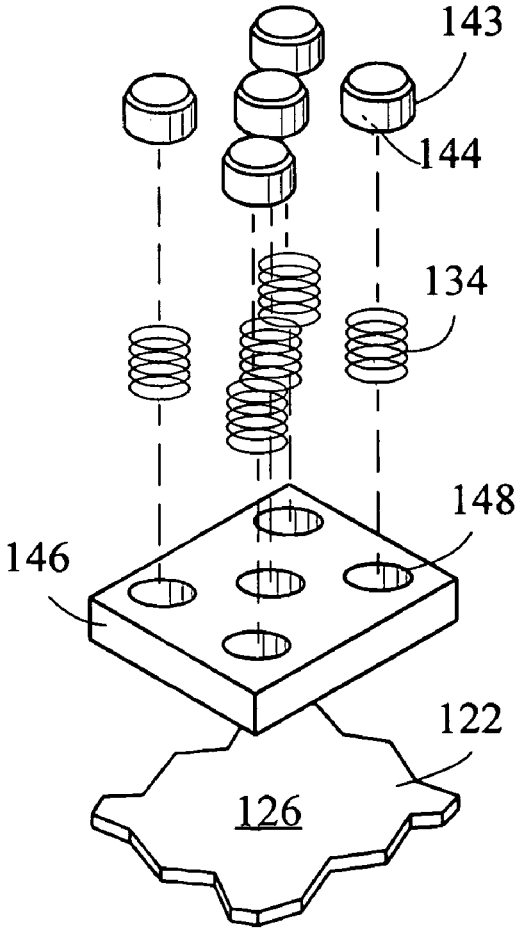
FIG. 11 is an exploded perspective view showing elements of an arch support module; and, FIG. 12 is a perspective view of the cushioning system installed in a shoe.

FIG. 11 is an exploded perspective view showing elements of arch support module 140 (refer to FIGS. 7-10). Springs 134 are received by first cavities 144 in protuberance 143 and second cavities 148 in heel cushion 146. Heel cushion 146 is disposed between insert 122 and protuberances 143.

Figure 12:
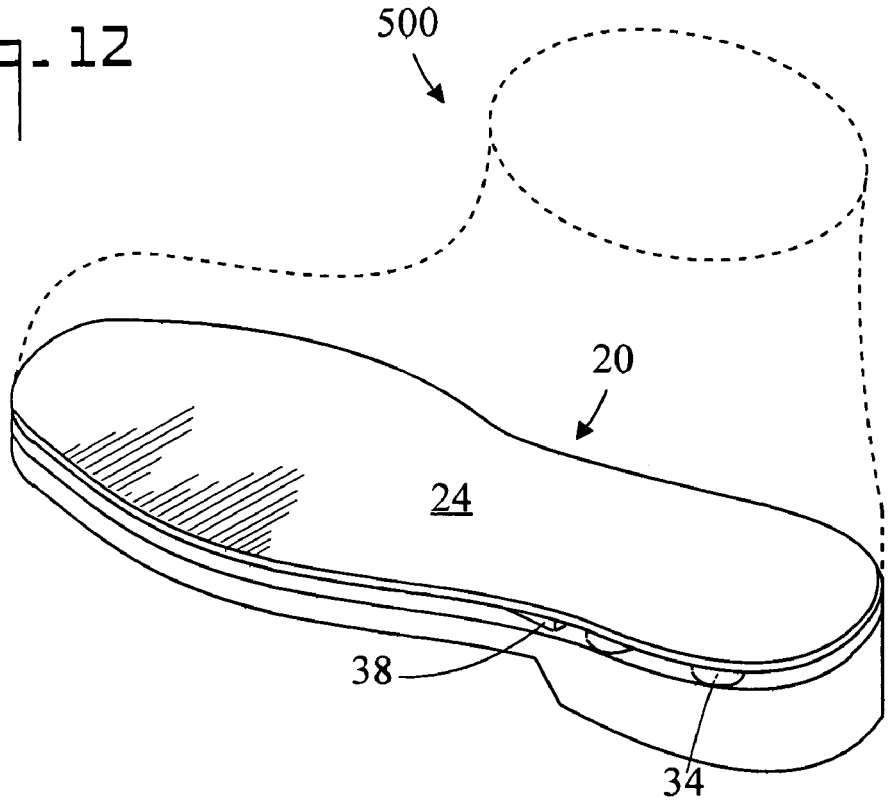

FIG. 12 is a perspective view of cushioning system 20 installed in a shoe 500. Cushioning system 20 is removably placed in shoe 500 so that it resides on top of the shoe's sole. Cushioning system 120 is similarly placed in shoe 500. It is desirable to first take out any removable inner sole or liner which shoe 500 may have in order to make room for the cushioning insert system 20 of the present invention.

The preferred embodiments of the invention described herein are exemplary and numerous modifications, variations, and rearrangements can be readily envisioned to achieve an equivalent result, all of which are intended to be embraced within the scope of the appended claims.

We claim:

1. A cushioning system for a shoe, comprising:

an insert having a top surface, an opposite bottom surface, said bottom surface having a heel portion, an arch portion, and a ball portion;

at least one spring connected to said heel portion of said bottom surface;

an arch support connected to said arch portion of said bottom surface;

an arch support module connected to said bottom surface, said arch support module substantially covering said heel portion and said arch portion;

said arch support module carrying said at least one spring and said arch support;

said arch support module including at least one protuberance, said protuberance having a first cavity for receiving said at least one spring;

said arch support module including a heel cushion disposed between said insert and said protuberance, said heel cushion having a second cavity for receiving said at least one spring; and, said at least one spring received by both said first cavity of said protuberance and said second cavity of said heel cushion.

2. A cushioning system for a shoe, comprising:

an insert having a top surface, an opposite bottom surface, said bottom surface having a heel portion, an arch portion, and a ball portion;

five springs arranged in an x-shaped pattern connected to said heel portion of said bottom surface;

an arch support connected to said arch portion of said bottom surface;

an arch support module connected to said bottom surface, said arch support module substantially covering said heel portion and said arch portion;

said arch support module carrying said five springs and said arch support;

said arch support having a wedge shape;

a ball cushion connected to said ball portion of said bottom surface;

said arch support module including five protuberances, said five protuberances each having a first cavity for receiving one said spring;

said arch support module including a heel cushion disposed between said insert and said protuberances, said heel cushion having five second cavities for receiving said five springs;

said five springs received by both said first cavities of said protuberances and said second cavities of said heel cushion; and, said arch support module including a plurality of ventilation holes.

* * * * *